US006612210B1

(12) United States Patent
Dockter et al.

(10) Patent No.: US 6,612,210 B1
(45) Date of Patent: Sep. 2, 2003

(54) SHAPE SAWING MACHINE

(75) Inventors: Mike Dockter, Woodland, WA (US); Michael P. Knerr, Ridgefield, WA (US); Glen O. Chambers, Woodland, WA (US)

(73) Assignee: U.S. Natural Resources, Inc., Vancouver, WA (US)

( * ) Notice: Subject to any disclaimer, the term of this patent is extended or adjusted under 35 U.S.C. 154(b) by 257 days.

(21) Appl. No.: 09/652,851

(22) Filed: Aug. 31, 2000

Related U.S. Application Data

(60) Division of application No. 09/215,111, filed on Dec. 17, 1998, now Pat. No. 6,282,526, which is a continuation-in-part of application No. 08/921,779, filed on Sep. 2, 1997, now Pat. No. 6,178,858.

(51) Int. Cl.[7] ..... B26D 5/40; B26D 5/20

(52) U.S. Cl. ..... 83/76.8; 83/368; 83/371; 83/404.1; 83/407; 83/420; 83/421; 83/425.3; 83/428; 83/445; 144/3.1; 144/39; 144/357; 144/358

(58) Field of Search ..... 83/76.8, 368, 409.1, 83/407, 420, 421, 425.3, 361, 371, 425.2, 426, 446; 144/3.1, 39, 356, 357, 378

(56) References Cited

U.S. PATENT DOCUMENTS

| | | | | | |
|---|---|---|---|---|---|
| 261,728 | A | * | 7/1882 | King | 83/425.3 |
| 4,127,044 | A | * | 11/1978 | Kenyon | 83/446 |
| 4,144,782 | A | * | 3/1979 | Lindstrom | 83/420 |
| 4,209,005 | A | * | 6/1980 | Tremeau | 83/703 |
| 4,455,910 | A | * | 6/1984 | Kraft et al. | 83/874 |
| 4,548,247 | A | * | 10/1985 | Eklind | 83/425.3 |
| 4,599,929 | A | * | 7/1986 | Dutina | 144/39 |
| 5,243,888 | A | * | 9/1993 | Bowlin | 83/368 |
| 5,421,386 | A | * | 6/1995 | Lundstrom | 144/357 |
| 5,722,474 | A | * | 3/1998 | Raybon et al. | 144/357 |
| 5,816,302 | A | * | 10/1998 | Newnes | 144/357 |

FOREIGN PATENT DOCUMENTS

| | | | | |
|---|---|---|---|---|
| DE | 549565 | * | 3/1931 | 83/404.1 |
| DE | 2836413 | * | 2/1980 | 83/421 |
| FR | 9206 | * | 11/1852 | 83/420 |

* cited by examiner

*Primary Examiner*—M. Rachuba
(74) *Attorney, Agent, or Firm*—Robert L. Harrington; Schwabe, Williamson & Wyatt, P.C.

(57) ABSTRACT

A shape sawing system for sawing lumber pieces from a curved cant. The cant is scanned by scanners and the scan data is input to a computer. The computer determines a curved path for the saw to follow in sawing the cant into lumber pieces. The saw is laterally and pivotally adjustable to follow the determined path established by the computer. The saw is a plurality of circular saw blades having a defined cutting edge portion that is inclined from a leading point at the bottom of the cant to a trailing point at the top of the cant. The point of pivot of the saws is between the leading point and the trailing point of the cutting edge portion. The saw assembly is mounted on pads having a low coefficient of friction. Pressurized air and lubricant are delivered to the pads to reduce the friction.

4 Claims, 4 Drawing Sheets

SHAPE SAWING MACHINE

This application is a division of application Ser. No. 09/215,111, filed, Dec. 17, 1998, now U.S. Pat. No. 6,282,526, which is a continuation-in-part of U.S. Ser. No. 08/921,779 now U.S. Pat. No. 6,178,858, and the disclosure thereof is incorporated herein by reference.

FIELD OF THE INVENTION

This invention relates to a shape sawing apparatus wherein a curved log or cant (hereafter collectively referred to as a cant) is cut along curved lines to maximize the production of lumber therefrom and more particularly it relates to the apparatus that manipulates the saws for obtaining the curved cut.

BACKGROUND OF THE INVENTION

The benefit of producing lumber from curved cants by cutting the cants along a curved cutting line, as dictated by the configuration of the cants, is well known to the industry. One way of accomplishing such curved cutting is by feeding the cants in a linear path to the saws and manipulating the saws rotatively and laterally to follow a projected curved cutting line through the cant. It is this cutting process to which the present invention is directed.

The required movements of the saw, i.e., laterally and rotatively, has heretofore required a carriage for the saw that is movably mounted on a base member, e.g., rotatively, with that base member movably mounted, e.g., laterally, on a second but fixed base member. The provision of such dual movement on dual base members is both complex and expensive. It is an objective of this invention to produce the desired dual movements on a single fixed base member.

Determining the optimum positioning of the saw is also an objective of this invention. The saw that is used for cutting is a bank of planar circular saw blades. The portion of the circular periphery of the rotating saw blade that cuts the cant is angled upwardly and rearwardly and is substantially a straight inclined cutting edge. FIG. 6 illustrates the cutting of a cant by a circular saw blade and the portion referred to as the inclined cutting edge portion is between points 104 and 102. This cutting edge portion has both length and height and the length portion is straight whereas the projected kerf being cut by the blade is curved. Thus the blade is constantly repositioned to follow the kerf and because the blade is straight and the kerf is curved, only a single point on the cutting edge portion of the blade can be truly on the projected kerf. This point is referred to as the point of tangency. The effect on the lumber being cut is that the sawn side of an outside or face board is not flat and thus not parallel to the chipped outer flat side produced by a chipper. (Chipper cutting occurs along a vertical line and thus produces a flat face regardless of alignment.)

In known prior devices, the closely adjacent but necessarily spaced apart saw and chipper are commonly mounted for simultaneous positioning, laterally and pivotally. Any change to the assembly affects both the chipper and the saw blade, and the point of tangency (determined by the pivot point for the assembly) is established rearward of the chipper and forward of the saw. Neither the chipper or the cutting blade is precisely positioned on the projected kerf and the sawn side is not only not flat but it is non-symmetrical which can affect the grading of the lumber.

SUMMARY OF THE INVENTION

The preferred embodiment of the present invention has a carriage that carries the saw, the carriage being movably mounted both rotatively and laterally on a single fixed base member. The base member is a large plate having an upper flat surface including a lateral slot near its center. The carriage has depending multiple strategically positioned pads with flat bottoms that engage the flat surface of the base member and which support the weight of the saw.

Depending from the center of the carriage is a post that fits into the slot of the base and defines the pivotal axis. Hydraulic cylinders strategically positioned between the support and base move the carriage both laterally and pivotally as permitted by the sliding connection of the post in the lateral slot. The pads simply slide on the flat plate. The materials of the pad and flat surface of the plate are selected to minimize friction. A pliable skirt surrounding each pad provides a seal to inhibit contaminants, and an inlet to the center of each pad injects oil and air between the engaging surfaces. The oil lubricates the surface (reducing friction) and the air (depending on pressure) provides a partial air cushion between the pads and surface and/or an air curtain at the rim of the pad to assist the skirt in preventing contamination between the engaging surfaces. The pads are able to slide in any direction on the base member but are confined by the limited linear movement of the carriage post in the slot of the base member and rotatively by the reach of the hydraulic cylinders. A computer is programmed to control the cylinders for achieving the desired position of the saw or saw blades carried by the carriage.

To optimize the sawed face of the lumber, a point of tangency is established behind the leading point of the cutting edge portion and in front of the trailing point of the cutting edge portion. The preferred position is about midway between these points. This establishment of the point of tangency for the saw blades is accomplished by strategically positioning (laterally) the pivot for the carriage and also the positioning (pivotally) of the saw along a radial line that passes through the desired points of tangency for each of the saw blades. The computer controls the pivoting of the saws about the pivotal axis to align the points of tangency with the radius of the kerf's curvature.

The cutting done by each cutting edge portion both before and after this point of tangency will be offset from the computed or projected kerf. However, both before and after the mid-point the offset is in the same direction, i.e., as viewed in plan view the entry and exit points will both be at the convex side of the kerf. At any vertical cross section the face of the board, top to bottom, is slightly curved being convex on one side of the cut and concave on the other side of the cut. The thickness of the boards at the top and bottom edges will be essentially the same and the middle slightly less or greater assuming the cut board is a face board having a flat exterior face, e.g., produced by a chipper.

In the prior method with the pivotal axis in front of the saw, the cut starts at an offset position from the cutting line and continues to increase in that same offset direction and thus produces an angled face top to bottom (that is also slightly curved) with the top and bottom edges of the board having different thickness dimensions.

Recognition of the effect involved when a circular, planar blade is cutting a curved kerf enables the optimum placement of the pivot axis and thus the point of tangency as described above. The boards that are cut satisfy industry standards where they may not satisfy those same standards using prior cutting methods.

The above improvements will be more fully appreciated and understood upon reference to the following detailed description and drawings referred to therein.

DESCRIPTION OF THE PREFERRED EMBODIMENT

Figure 1:
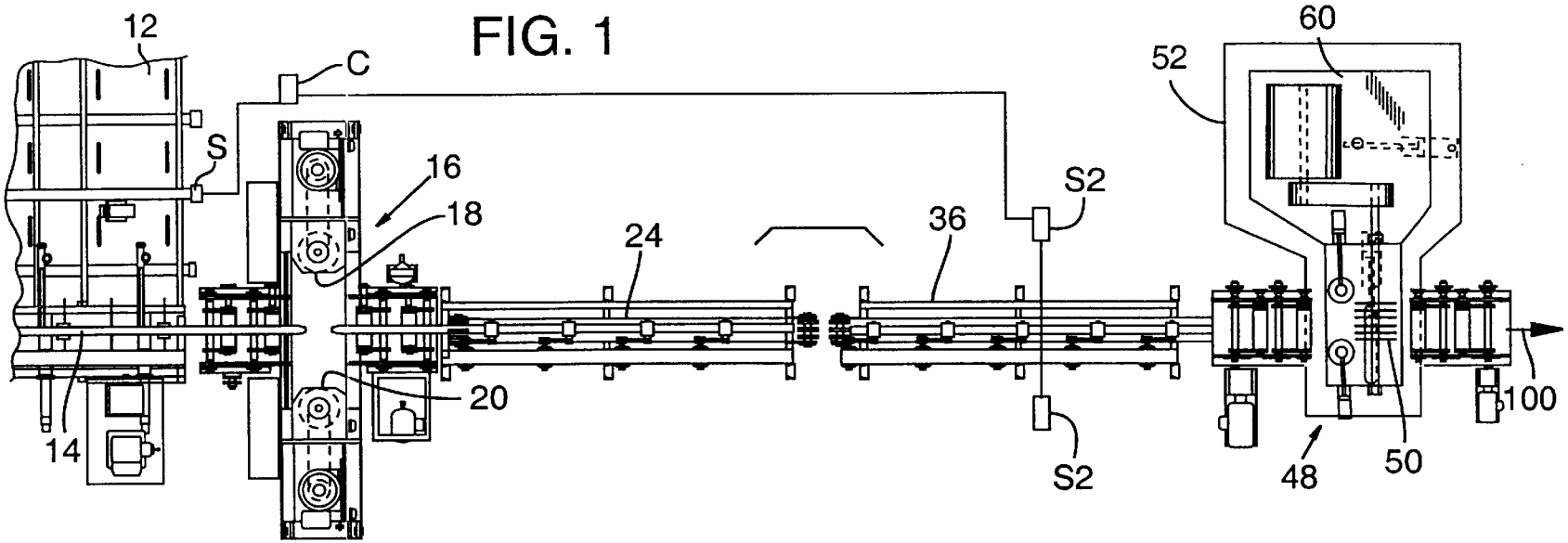
FIG. 1 is a top plan view of a shape sawing system of the present invention.
Figure 2:
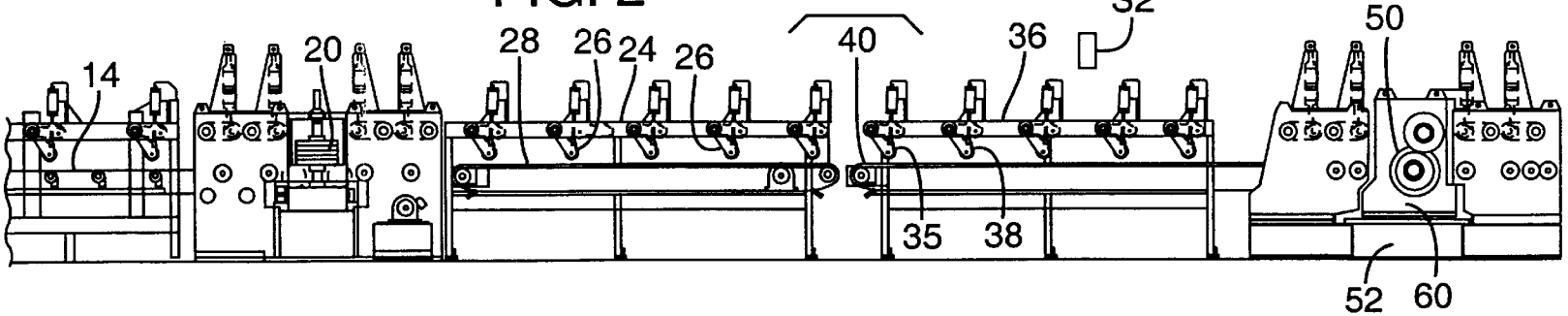
FIG. 2 is a side elevation view of the shape sawing system of FIG. 1.

FIGS. 1 and 2 illustrate a shape sawing system of the present invention. The system has a conveyor 12 for delivering a cant L onto an infeed conveyor 14. A scanner S scans the cant L to determine its position. A computer C processes the scan data and will control the conveyor 12 to position the cant L in a desired position on the infeed conveyor 14. The conveyor 14 feeds the cants L sequentially into a chipper assembly 16. The cant L is a log that has been processed by a previous chipping operation to produce flat top and bottom surfaces. The chipper assembly 16 has opposed chippers 18 and 20 that will produce opposed flat side faces on the cant L that is being transported by the conveyor 14. Often the cant L has a curvature or bow along its length. The chippers 18 and 20 are arranged to produce opposed parallel flat surfaces along the curvature of the cant L.

The cant L as it leaves the chipper assembly 16 is delivered to an out feed table 24. The out feed table 24 has hold down rollers 26 and a chain-type conveyor 28 that maintains the cant L in position. Cant L is then transferred to an infeed table 36 which also has hold down rollers 38 and a chain-type conveyor 40 that maintains the cant L in position. As the cant L is transported on the infeed table 36, scanner S2 will scan the cant L to determine its exact position and also the profile of the cant L. The scan data from the scanner S2 is input to the computer C and the computer C will utilize the scan data to control the operation of the saw assembly 48. The above is but one of a number of arrangements for readying a cant for sawing and is presented as but one example of such arrangements. The invention is directed to the sawing operation which is now explained.

The cant L as contemplated herein has a curvature along its length. Sawing the cant L into straight wood pieces such as boards with the cant fed along a fixed linear path will not maximize production from the cant L. It is therefore desirable to control the saw to follow a pre-determined curvature as determined by the computer from the scan data in order to maximize the number of lumber pieces obtainable from the cant L.

Figure 3:
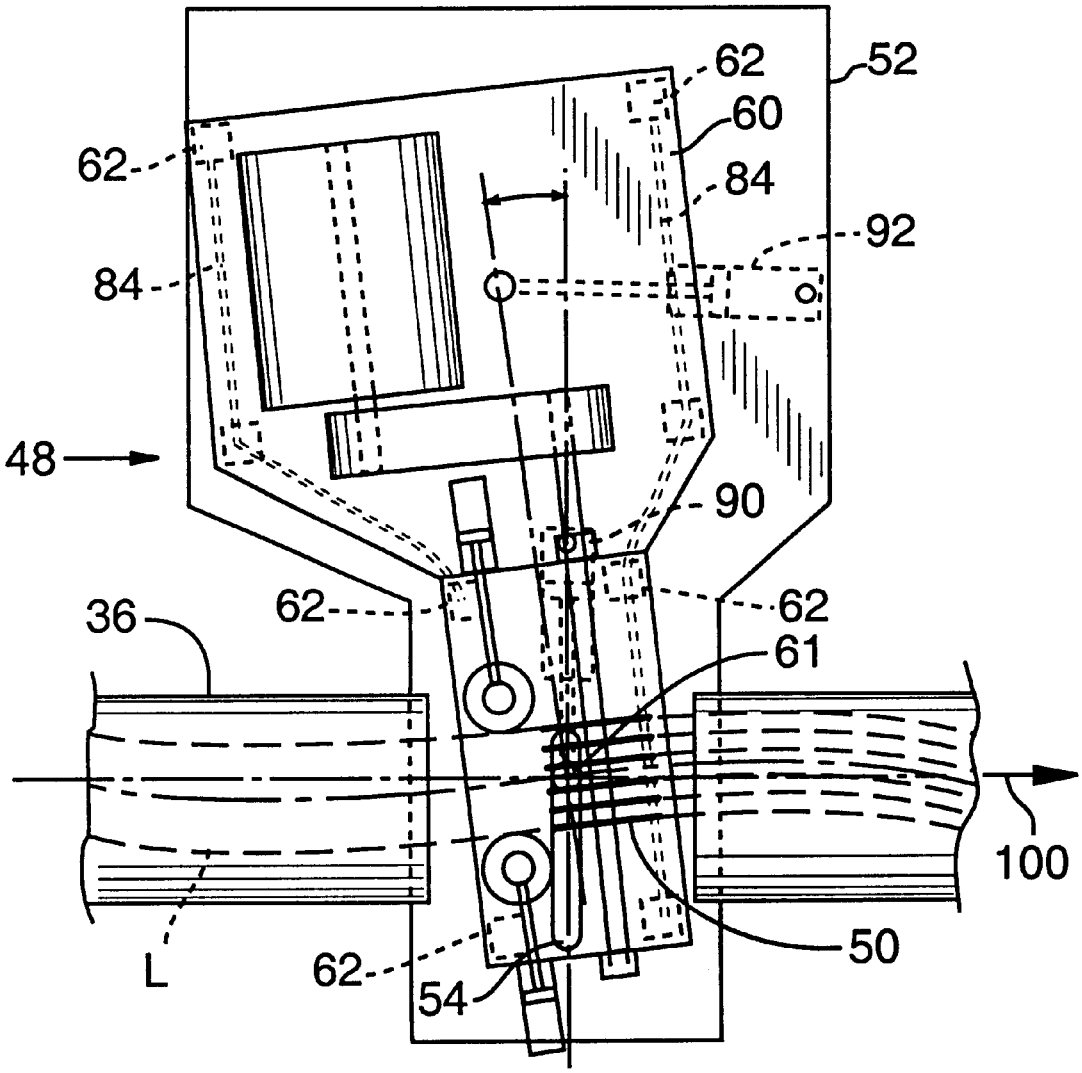
FIG. 3 is a diagrammatical view of the saw assembly of FIG. 1.

FIG. 3 illustrates the pivoting and lateral movements of the saw or saw blades 50 of saw assembly 48. The saw assembly 48 has a base 52 that is positioned strategic to the infeed conveyor 36. The base 52 has a flat top surface and has a slot 54 positioned normal to the flow direction of the conveyor 36. A carriage 60 is movably mounted on the base 52 and is supported on multiple pads 62 having a low coefficient of friction. The pads 62 are mounted to pad holders 64 (FIG. 4) with the holders 64 being fixedly mounted to the underside of the carriage 60.

Figure 4:
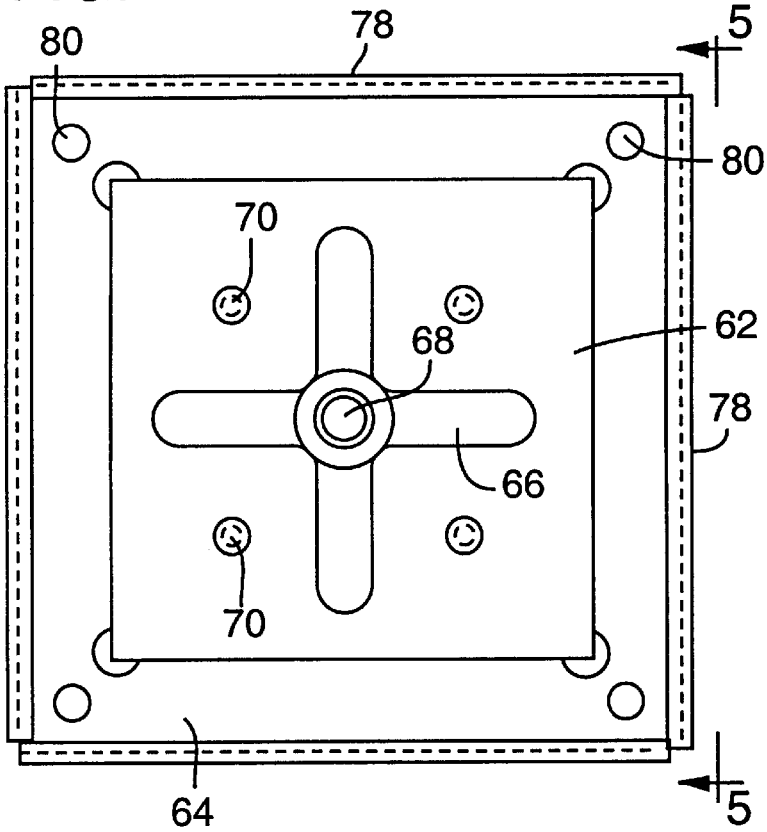
FIG. 4 is a view of one of a number of pads and holders which provide bearing members for the saw assembly of FIG. 3.
Figure 5:
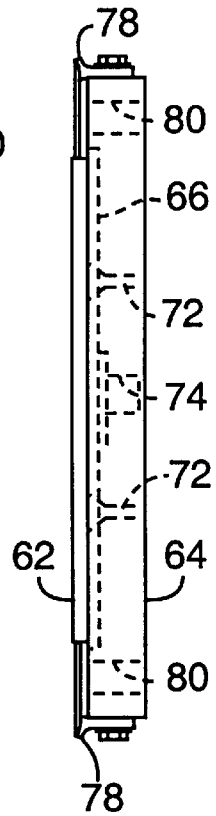
FIG. 5 is a view of the pad and holder of FIG. 4 as viewed on view lines 5—5.

A pad 62 and holder 64 are further illustrated in FIGS. 4 and 5. The pad 62 is generally rectangular (square) in shape. A cross shaped recess 66 is provided in the center of the pad 62 and has a center through bore 68. Countersunk through bores 70 are provided to facilitate mounting of the pad 62 to the holder 64 by conventional fasteners. The holder 64 has a recess 66 (FIG. 5) to receive the pad 62 and threaded bores 72 that align with the bores 70 of the pad 62. As seen in FIG. 5, the pad 62 extends outward from the holder 64. The holder 64 has a center through bore 74 aligned with through bore 68 of pad 62. Wipers 78 are mounted around the perimeter of the holder 64 by conventional fasteners and project from the holder 64 substantially the same distance as the pad 62. The wipers 78 will be in contact with the flat surface of base 52 and form a protective skirt surrounding the pad to inhibit contaminants from entering between the pad 62 and the bearing surface of base 52. Bores 80 are provided in the holder 64 to facilitate mounting the holders to the under side of the carriage 60.

Pressurized air and lubricant are supplied to the holder 64 and pad 62 by lines 84 (FIG. 3) connected to the center bores 74 of the holder 64 and thus the center bore 68 and recess 66 of the pad 62. The pressurized air provides a lifting force and in conjunction with the lubricant supplied to the pads 62 reduces the frictional engagement between the pads 62 and the base 52.

Refer again to FIG. 3 which illustrates in diagram form the arrangement of the saw assembly 48. The carriage 60 is movably mounted on the base 52 with a pin 61 of the carriage 60 fitting in the slot 54 in the base 52. The pin 61 thus provides the pivot point for the carriage 60 on the base 52. The carriage 60 is laterally adjusted on the base 52 by a cylinder 90 that is coupled between the base 52 and the carriage 60 in a conventional manner. Another cylinder 92 is provided to pivotally adjust the carriage 60 on the base 52. The cylinder 92 is coupled between the base 52 and the carriage 60 in a conventional manner. The saw assembly 48 is thus movable laterally (cylinder 90) and pivotally (cylinder 92) such that the plane of the saws 50 of the saw assembly 48 and more particularly the portion of the periphery of the saws that provide the cutting action, can be properly aligned relative to the computed (projected) kerf to be cut.

Figure 7:
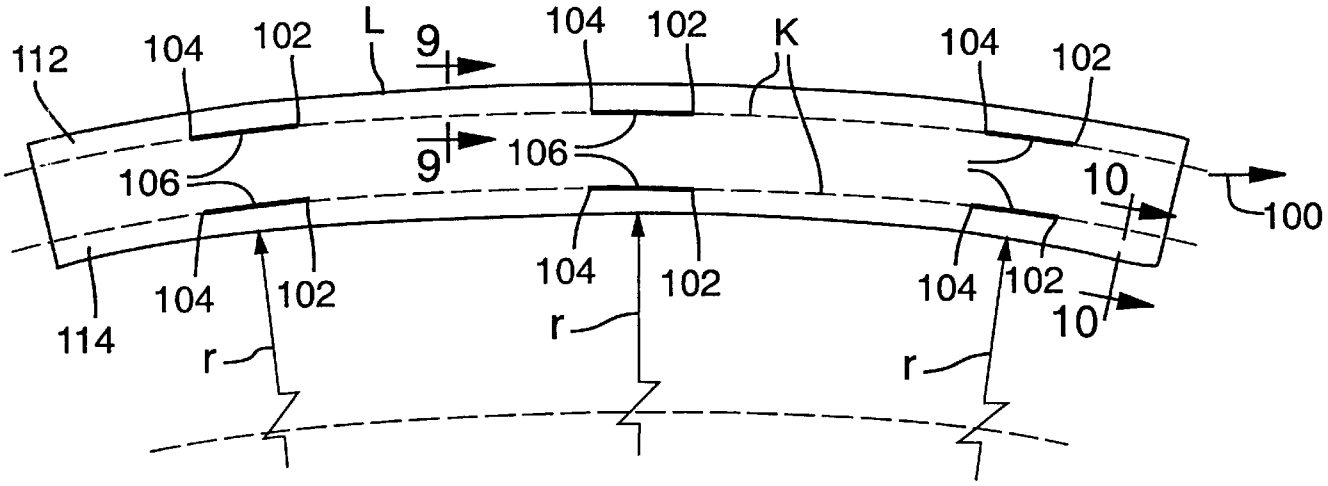
FIG. 7 is a plan view illustrating the relationship of the cutting edge portions of a pair of saw blades cutting a pair of projected kerf lines extended along a curved cant.

FIG. 7 illustrates in diagram form a cant L that has been by previously processed, e.g., by the chipper assembly 16 and now has top and bottom flat surfaces as well as opposed flat side surfaces. The cant L is shown in plan view as having a curvature or a bow in its profile along the length of the cant L. The curvature may be complex, i.e., having different degrees of curvature along its length and a radius r at any point along the cant may have a different center point. Three radius lines r are illustrated but of course a radial line may be drawn at any position along the length of the cant. The computer C will, from the scan data that has been input to it from the scanners S and S2, (FIG. 1) compute an optimum saw path or kerf indicated by dash lines K in FIG. 7 to maximize the board output from the cant L. Generally the saw path K will follow the curvature of the cant L. However, it will be appreciated that the computed path may deviate from the curvature of the cant L as required to produce the optimum board production. As the cant L is transported by the infeed conveyor to the saw assembly 48, the saw assembly is adjusted on the base 52 by manipulation of the cylinders 90, 92 (FIG. 3). The saw assembly may be moved laterally and/or pivotally as required depending on the intended saw path for the saw or saw blades 50.

Figure 6:
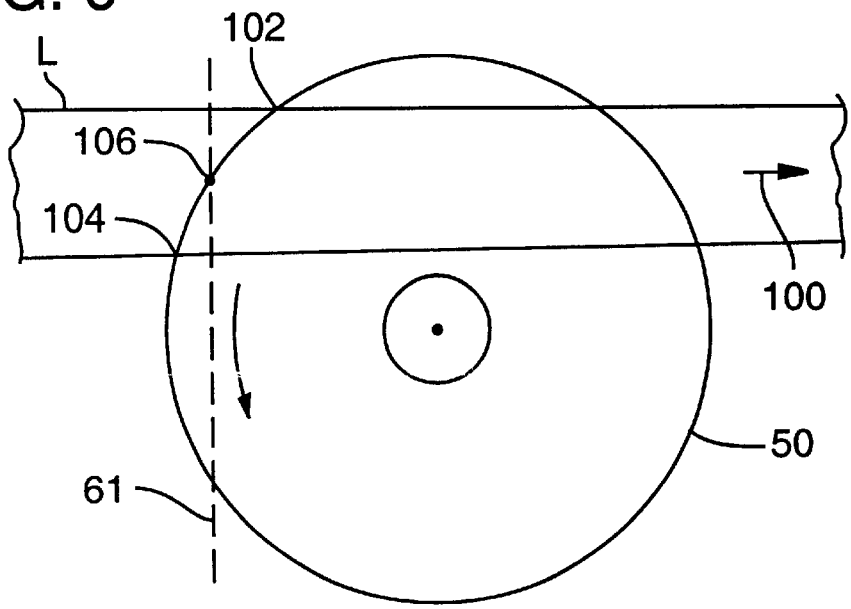
FIG. 6 is a side view illustrating in overlay the relationship of a saw blade and a cant during cutting.

The pivot axis about which the saw pivots (around the axis of pin 61) and its location relative to the leading or cutting edge of the saw is considered important to provide the optimum saw cut by the saw. FIG. 6 is an overlay illustration of the saw blades that are in the process of cutting a kerf K in a cant L. The cant L is being fed in a direction indicated by arrow 100 and the saw blade 50 will saw the cant L as it is being fed by the infeed conveyor.

As indicated in FIG. 6, the pivot axis 61 of the saw assembly 48 is positioned longitudinally to be between a trailing point 102, whereat the saw blade 50 of saw assembly 48 rotates into engagement with the cant L, and a leading point 104, whereat the saw blade 50 rotates out of engagement with the cant L. The peripheral edge portion between 102 and 104 of the rotating saw blade 50 is referred to as the cutting edge portion or cutting edge of each of the saw blades. The pivot axis 61 is positioned between the entry point 102 and exit point 104 of the illustrated saw blade with the bank of saw blades aligned with the applicable radius. (See FIG. 7) This radius r passes similarly through all the blades and preferably about mid-way between the entry point 102 and the exit point 104. Point 106 indicates the projection of the pivot line r through the mid-point which similarly projects through the mis-point of all of the saw blades 50 of the saw assembly 48 (compare FIGS. 6, 7 and 8).

Figure 8:
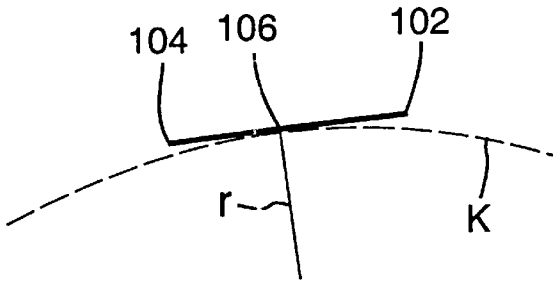
FIG. 8 is an enlarged partial view illustrating in exaggeration a kerf line of FIG. 7 to visually portray the effect of the straight blade cutting along a curved kerf.

Refer now to FIGS. 7 and 8 of the drawings. Computed upper and lower curved kerf lines K are shown in FIG. 7. A cutting edge portion for each of two blades are shown at three different positions along the cant. Because the cutting edge between points 104 and 102 is substantially a straight line (the blade being planar) and because the point 106 is controlled to follow the curved kerf line K with cutting edge 102, 104 positioned normal (tangential) to radius r, both points 102 and 104 are skewed to the convex side of the projected kerf. (See the exaggerated enlargement of this relationship in FIG. 8.) This positional relationship remains continuous throughout the cutting operation as the saw blade is controlled to provide for the cutting edge 102–104 of each blade to remain tangential to the desired kerf. This is illustrated at the three different positions of the pair of blade portions which are sawing the face boards off the cant to which the invention is particularly applicable.

Figure 10:
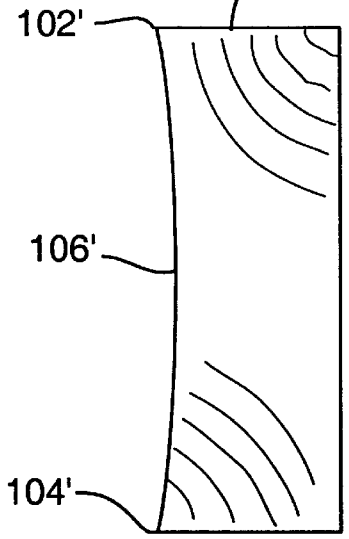
FIG. 10 is a cross sectional view of a face board sawn from the cant as viewed on view lines 10—10 of FIG. 7.
Figure 9:
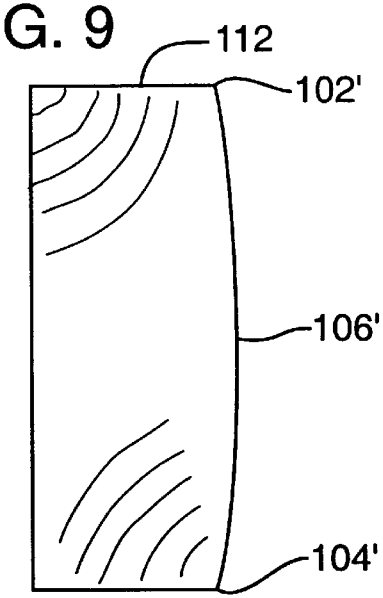
FIG. 9 is a cross sectional view of a face board sawn from the cant as viewed on view lines 9—9 of FIG. 7.

As previously explained, the cutting edge at point 106, i.e., the center between the top and the bottom of the board, is always located on the kerf K and the cutting edge at 104, the bottom of the board, and at point 102, the top of the board, is always offset from the projected kerf K to the convex side of the kerf. FIG. 9 illustrates the face board 112 of FIG. 7 which is taken from the convex side of the cant (note view lines 9—9) and FIG. 10 illustrates the face board 114 of FIG. 7 which is taken from the concave side of the cant (note view lines 10—10). The cutting edge points 102, 104 and 106 are projected onto FIGS. 9 and 10 as 102', 104' and 106', respectively. The curved faces are exaggerated for illustration purposes. It will be noted that for both boards there is a difference as between the width dimension at the center 106' and either of the top and bottom, whereas the top and bottom (102' and 104') are substantially the same dimension. This is an objective of the invention and satisfies industry standards which require equal top and bottom edge thickness dimensions.

Those skilled in the art will recognize that modifications and variations may be made without departing from the true spirit and scope of the invention. The invention is therefore not to be limited to the embodiments described and illustrated but is to be determined from the appended claims.

What is claimed is:

1. A system for curved cutting of logs or cants conveyed along a liner pathway comprising:

a conveyor conveying a curved cant or log;

a scanner scanning the cant or log and a computer receiving information from the scanner for determining a desired curved cutting line for the cant or log;

a saw assembly including a saw mounted for lateral and rotative movement, said rotative movement defining a pivotal axis of the saw;

said saw including at least one planar circular cutting blade having a peripheral cutting edge portion defined as the portion of the peripheral cutting edge in engagement with and cutting the log or cant and having a leading point and a trailing point of contact with the log or cant;

said computer controlling the lateral and rotative positioning of the saw during cutting of said log or cant to position said cutting edge portion on a line tangent to the curved cutting line with the point of tangency located between the leading and trailing points of the cutting edge portion.

2. A system as defined in claim 1 wherein the pivotal axis for the saw is located in the path of conveyance between the leading and trailing points of the cutting edge portion.

3. A system as defined in claim 1 wherein the point of tangency is substantially mid-way between the leading and trailing points of the cutting edge portion.

4. A system as defined in claim 1 wherein the saw includes a plurality of side-by-side planar circular saw blades including said at least one circular saw blade, each of said saw blades having a cutting edge portion, said computer determining a plurality of desired curved cutting lines to be cut by said plurality of circular saw blades, said positioning of the saw positioning each of the cutting edge portions on a line tangent to the curves of the cutting lines with the point of tangency for each located between the leading and trailing points.

* * * * *